United States Patent [19]

Dahl et al.

[11] Patent Number: 4,890,551

[45] Date of Patent: Jan. 2, 1990

[54] APPARATUS FOR GUIDING THE ROLLS OF AN ESSENTIALLY VERTICAL CALENDER

[75] Inventors: Hans Dahl, Ravensburg; Josef Schneid, Vogt, both of Fed. Rep. of Germany

[73] Assignee: Sulzer-Escher Wyss GmbH, Ravensburg, Fed. Rep. of Germany

[21] Appl. No.: 176,292

[22] Filed: Mar. 31, 1988

[30] Foreign Application Priority Data

Apr. 3, 1987 [DE] Fed. Rep. of Germany ..... 3711334

[51] Int. Cl.[4] ..... B30B 3/04

[52] U.S. Cl. ..... 100/163 A; 100/47; 100/168; 100/170

[58] Field of Search ..... 100/47, 161, 162 R, 100/163 R, 163 A, 168, 169, 170; 72/232, 234

[56] References Cited

U.S. PATENT DOCUMENTS

| | | | |
|---|---|---|---|
| 3,157,110 | 11/1964 | Goddard | 100/170 |
| 3,180,251 | 4/1965 | Tidbury | 100/170 X |
| 3,364,848 | 1/1968 | Muller | 100/170 X |
| 3,584,570 | 6/1971 | Sass et al. | 100/168 X |
| 3,611,917 | 10/1971 | Bryce et al. | 100/170 X |
| 4,510,859 | 4/1985 | Berry | 100/170 X |
| 4,736,678 | 4/1988 | Stotz | 100/170 X |

*Primary Examiner*—Harvey C. Hornsby
*Assistant Examiner*—Stephen F. Gerrity
*Attorney, Agent, or Firm*—Werner W. Kleeman

[57] ABSTRACT

The roll calender containing superimposed rolls is provided with base elements which are vertically adjustable at the roll stand and in which there are pivotably mounted movable substantially lever-shaped elements. The roll bearings of the rolls of the roll calender are located at the ends of the movable substantially lever-shaped elements. Between the base elements and the movable substantially lever-shaped elements there are arranged force-applying elements which serve for compensation of overhanging loads. There are also provided stops against which the movable substantially lever-shaped elements are supported when the roll calender is opened or nip relieved.

25 Claims, 3 Drawing Sheets

APPARATUS FOR GUIDING THE ROLLS OF AN ESSENTIALLY VERTICAL CALENDER

CROSS REFERENCE TO RELATED APPLICATION

This application is related to the commonly assigned, copending U.S. application Ser. No. 07/182,086, filed, Apr. 15, 1988, and entitled "Calender With Nip Relieving Devices" now U.S. Pat. No. 4,823,690, granted Apr. 25, 1989.

BACKGROUND OF THE INVENTION

The present invention relates to a new and improved construction of an apparatus for guiding the rolls or rollers of an essentially vertical roll calender.

Generally speaking, the apparatus of the present development for guiding the rolls or rollers of an essentially vertical roll calender contains at each roll end of a roll a movable substantially lever-shaped element housing the roll bearing of the associated roll and serving for the compensation of overhanging loads. This movable substantially lever-shaped element is mounted to be essentially vertically pivotable, and the pivot axis thereof extends substantially parallel to the lengthwise axis of the associated roll. A force-applying element bears upon the movable substantially lever-shaped element and is capable of producing the force needed for the compensation of the overhanging loads and, if necessary, to preclude this force from from becoming effective, in order that the roll may be lowered.

An apparatus of this general type has been disclosed in the not pre-published German patent application No. 3,640,161, published July 2, 1987 and the cognate U.S. patent application Ser. No. 06/941,368, filed Dec. 15, 1986, now U.S. Pat. No. 4,736,678, granted Apr. 12, 1988. In this prior art apparatus, the force-applying element is always supported upon a part which is separately fastened to the roll stand of the roll calender. This is associated with the disadvantage that in the presence of a change in the diameter of one or several rolls, for example, due to roll re-grinding or re-facing, it is complicated to re-adjust both parts, namely the lever member and the support part described in the aforementioned German patent application No. 3,640,161 and the cognate U.S. Pat. No. 4,736,678.

SUMMARY OF THE INVENTION

Therefore, with the foregoing in mind, it is a primary object of the present invention to provide a new and improved apparatus for guiding the rolls of an essentially vertical roll calender in a manner which does not exhibit the aforementioned drawbacks and shortcomings of the prior art.

A further important object of the present invention aims at obviating the aforementioned drawbacks and shortcomings and, in particular, devising an improved apparatus for guiding the rolls of an essentially vertical roll calender, such that the aforementioned re-adjustment is effected by altering the position of a single or individual element or part, so that the re-adjustment can be, for instance, power or motor operated.

Still another significant object of the present invention relates to a new and improved construction of an apparatus for guiding the rolls of an essentially vertical roll calender in an extremely efficient and reliable manner, also rapidly and protectively with respect to avoiding damage to the rolls, particularly the roll shell of a controlled deflection roll incorporated in the roll calender.

Yet a further important object of the present invention resides in the provision of a new and improved construction of a roll calender, containing an essentially vertical stack of rolls or rollers which can be guided and supported in an extremely efficient and reliable fashion and wherein re-adjustment of the roll position of the individual rolls can be accomplished independently of one another relatively simply, accurately and with minimum constructional expenditure.

Now in order to implement these and still further objects of the invention, which will become more readily apparent as the description proceeds, the apparatus of the present invention is manifested, among other things, by the features that for each roll end a base element or part is provided which is substantially vertically adjustable at the roll stand of the roll calender and arrestable or lockable in a predeterminate set or adjusted position. At the base element there is arranged the pivot bearing of the movable substantially lever-shaped or lever-type element, at which there is located the bearing of the associated roll end. Moreover, the force-applying element is arranged between the associated base element or part and the movable substantially lever-shaped or lever-type element.

The base element or part thus can be guided essentially vertically in a sliding or slide guide or guide structure provided at the roll stand of the roll calender, sometimes simply referred to as a calender. In this way, a simple and reliable guidance of the base element or part can be obtained in essentially vertical direction.

The positional fixing or locking of the base element or part can be effected by means of an adjustable positioning device. Preferably, this positional fixing or locking of the base element or part can be effected by an adjustment or setting collar or ring which is threaded or screwed onto a threaded spindle or spindle member, and at which adjustment or setting collar there bears or rests the associated base element or part.

The threaded spindle or spindle member can be rotated, for instance, by the action of a suitable power device, typically a motor drive, and the force-applying element can be actuatable in a predeterminate or reverse direction from that employed for nip relieving to produce a reliable relieving force at the base element or part for avoiding unwanted or unintentional adjustment of the adjustment or setting collar or ring when the threaded spindle or spindle member is rotated. In this manner, the base element or part is lifted from the associated adjustment or setting collar or ring, so that such adjustment or setting collar or ring can rotate in conjunction with the threaded spindle and therefore cannot be positionally adjusted.

Between each base element and the movable substantially lever-shaped element or equivalent structure there can be arranged an adjustable stop or abutment against which the movable substantially lever-shaped element is supported with the roll calender downwardly opened when the associated roll or roller is lowered.

In this manner, the apparatus for the compensation of overhanging loads at the roll ends is also suitable for the rapid opening of the roll calender, whereby the movable substantially lever-shaped or lever-type elements with the rolls diverge or move apart.

Each force-applying element can be advantageously structured and dimensioned so as to produce a force which exceeds the weight of the associated roll or roller. An adjustable stop or abutment is arranged between the base element or part and the associated movable substantially lever-shaped element or part. This adjustable stop or abutment upwardly limits the travel of the movable substantially lever-shaped element or part when the associated roll or roller is raised. There is thus afforded the possibility of also opening or nip relieving the calender by moving the rolls or rollers upwardly.

The movable substantially lever-shaped element can possess the shape of a single or one-armed lever or lever element, and the force-applying element is effective between the axis of rotation or pivoting of the single-armed lever and the associated roll bearing. There is thus obtained a specific construction which requires very little space and poses no problems as concerns the mounting of such arrangement at the roll stand of the roll calender.

However, the movable substantially lever-shaped element also can be structured to possess the form of a double or two-armed lever or lever element. In this case, the related force-applying element engages at the one arm of the movable substantially double-armed lever-shaped element and which one arm is located remote or facing away from the roll bearing. This arrangement has the advantage that there are required lower forces for operation of the force-applying element.

Each force-applying element preferably can be constituted by a piston-and-cylinder unit or device which can be acted upon with a pressurized hydraulic or gaseous medium which is at a suitable pressure.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
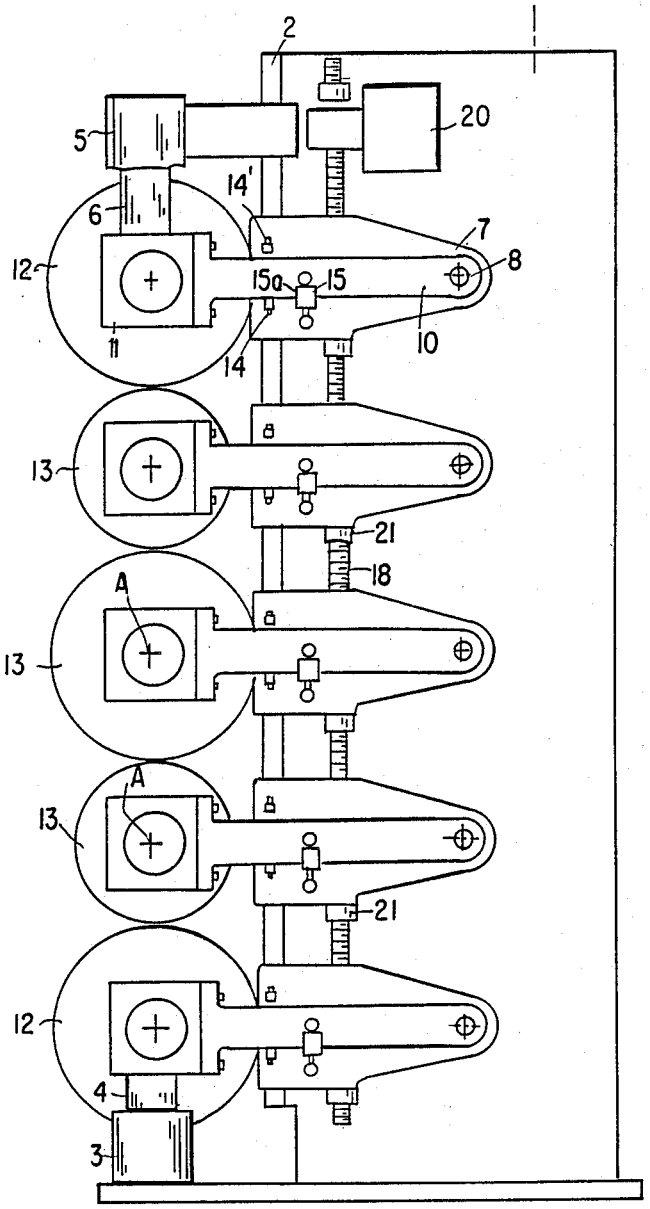
FIG. 1 illustrates in side view a roll calender equipped with roll guiding apparatus constructed according to the present invention and with the roll calender shown in its closed position or condition.

Describing now the drawings, it is to be understood that to simplify the showing thereof, only enough of the structure of the exemplary embodiments of apparatus for guiding the rolls of an essentially vertical roll calender has been shown therein as is needed to enable one skilled in the art to readily understand the underlying principles and concepts of this invention. Furthermore, since a construction of roll guide or guiding apparatus for the rolls of the roll calender is also provided at the opposite side from that shown in FIGS. 1 and 2 and since such construction is essentially the same as that depicted in the drawings, it will suffice to consider the construction of the roll guide or guiding apparatus at one end or side of the roll calender.

Figure 2:
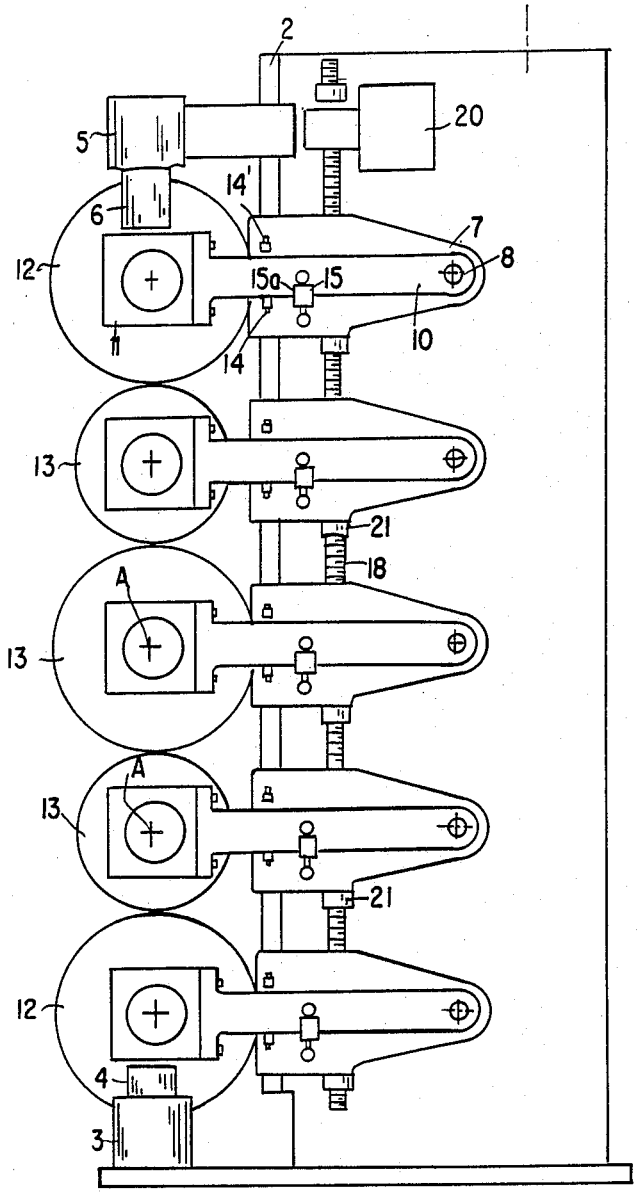
FIG. 2 illustrates the roll calender of FIG. 1 in the opened position or condition thereof, that is to say, nip relieved.

Turning now specifically to FIGS. 1 and 2 of the drawings, there is depicted therein a roll calender containing a roll stand or frame structure 1 on which there is formed or provided a substantially vertical sliding or slide guide or guide structure 2. Two contact pressure or pressing cylinders 3 and 5 are arranged along the vertical sliding guide or guide structure 2, namely a lower contact pressure or pressing cylinder 3 provided with a piston or piston member 4 and an upper contact pressure or pressing cylinder 5 provided with a piston 6. The lower contact pressure or pressing cylinder 3 is shown, for instance, as a free-standing or self-supporting structure while the upper contact pressure or pressing cylinder 5 is appropriately fixed to the substantially vertical sliding guide or guide structure 2. At this substantially vertical sliding guide or guide structure 2 there are arranged base elements or components 7 in which movable substantially lever-shaped or lever-type elements or parts 10 are mounted on pivots or pivot pins 8. Each of these movable substantially lever-shaped elements 10 carry at their ends neighboring an associated roll 12 or 13, as the case may be, a bearing or bearing means 11 for such rolls 12 or 13. The rolls or rollers 12 located at the top and bottom ends of the substantially vertical sliding guide or guide structure 2 are preferably controlled deflection rolls, while the intermediate rolls 13 are, in known manner and as occasion demands, hard or soft rolls which have to be periodically re-ground or re-faced.

The downward movement of each movable substantially lever-shaped element 10 is limited by an associated adjustable stop or abutment 14 and the upward movement thereof is limited by a likewise associated adjustable stop or abutment 14'. Each movable substantially lever-shaped element 10 is under the influence of an associated force-applying element or structure 15, in this case constituted, for instance, by a piston-and-cylinder unit or device 15*a* which can be connected via associated supply lines or conduits 16 and 17 (FIGS. 3, 4 and 5) with a suitable source 25 of pressurized fluid medium, such as hydraulic pressure medium or pressurized or pressure gas which is at a suitable pressure. Furthermore, there is also provided a substantially vertical threaded spindle or spindle member 18 with which there is operatively associated a suitable power or motor drive 20. Threaded onto the threaded spindle or spindle member 18 are adjustment or setting rings or collars 21 and each such adjustment or setting ring or collar 21 is operatively associated or positioned in coacting relationship with a related base element or component 7. These adjustment or setting rings or collars 21 define vertically adjustable stop or abutment elements or parts upon which the related base element or component 7 is supported during operation.

Figure 3:
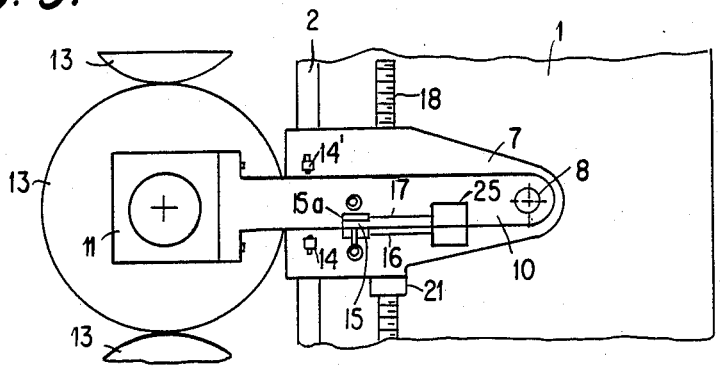
FIG. 3 illustrates a first embodiment of the roll guiding apparatus constructed according to the present invention, in which the movable substantially lever-shaped element possesses the form of a single or one-armed lever or lever element.
Figure 4:
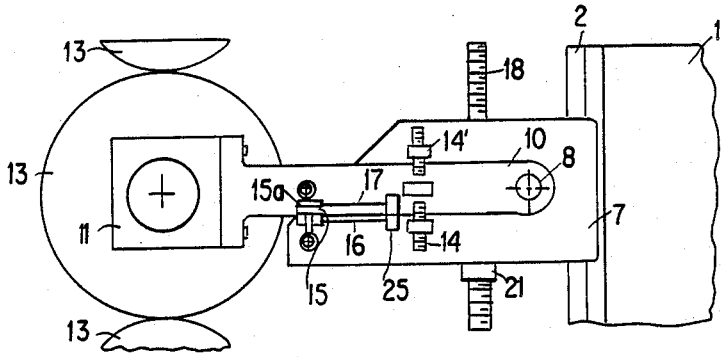
FIG. 4 illustrates a second embodiment of the roll guiding apparatus constructed according to the present invention.
Figure 5:
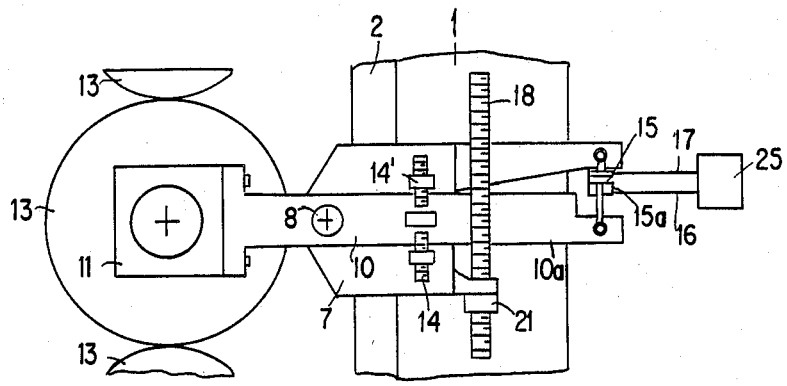
FIG. 5 illustrates a third embodiment of the roll guiding apparatus constructed according to the present invention, in which the movable substantially lever-shaped element possesses the form of a double or two-armed lever or lever element.

Different exemplary embodiments of the base elements or components 7 with the movable substantially lever-shaped elements 10 or the like are illustrated in each of FIGS. 3, 4 and 5.

FIG. 3 shows, on an enlarged scale, the embodiment according to FIGS. 1 and 2. FIG. 4 shows an exemplary embodiment in which the base element or component 7 is located essentially totally in front of the roll stand or structure 1.

In both embodiments according to FIGS. 3 and 4, a force-applying element 15 is located between the pivot or swivel axis defined by the pivot pin or pivot 8 of the associated movable substantially lever-shaped element 10 and the roll bearing or bearing structure 11 or the roll axis A (FIG. 1).

On the other hand, in the embodiment according to FIG. 5, the movable substantially lever-shaped element 10 possesses the shape of a double or two-armed lever or lever element with the pivot or pivot pin 8 located in the center zone or region of such double or two-armed lever or lever element. The associated force-applying element 15 acts upon the lever arm 10*a* which is located remote from the roll bearing 11.

During operation, with the roll calender closed according to the showing of FIG. 1, the rolls or rollers 12 and 13 are in a position in which they press against one another and process, typically roll a not particularly shown material web, such as a paper web, by way of example and not limitation. The adjustment or setting rings or collars 21 are set at the threaded spindle or spindle member 18 in such a manner that the base elements or components 7 supported by these adjustment rings or collars 21 are in a position in which the movable substantially lever-shaped elements 10 extend substantially in horizontal direction. The force-applying elements 15 then exert an upwardly directed force which compensates the overhanging loads, i.e. the weight of the roll bearings 11 and that of parts which are possibly mounted at such roll bearings 11. In this manner, the rolls or rollers 12 and 13 are essentially held free from bending or deflection influences which otherwise might arise by virtue of the presence of these loads.

When the roll calender should be opened or nip relieved, the contact pressure or pressing cylinder 3 and the force-applying elements 15 are operated such that they do not exert any power or force, whereby the movable substantially lever-shaped elements are lowered and abut against the associated adjustable stops or abutments 14. These adjustable stops or abutments 14 are staggered in such a manner that the movable substantially lever-shaped elements 10 diverge or move away from each other. This position is illustrated in FIG. 2.

An upward opening or nip relief of the roll calender is also possible but not here particularly shown. In this case each force-applying element 15 is dimensioned to produce a force which exceeds the weight of the related roll or roller 12 or 13, as the case may be. The upper contact pressure or pressing cylinder 5 is rendered pressureless, whereby the piston 6 is retracted or drawn in. At the same time, the force-applying elements 15 are exposed to a higher pressure by the associated supply line or conduit 17, i.e. a higher pressure than is otherwise required for the compensation of the overhanging loads so that the movable substantially lever-shaped elements 10 abut against the upper associated adjustable stops or abutments 14'. Here again, there is accomplished a staggered opening of the individual movable substantially lever-shaped elements 10 and thereby also of the rolls or rollers 12 and 13 which are shown in FIG. 2.

When the base elements or components 7 are initially set or positionally adjusted or when they have to be re-set or re-positioned after the rolls or rollers, here, for instance, the intermediate rolls 13, are re-ground or re-faced, the adjustment or setting rings or collars 21, in principle, can be manually adjusted to the correct height or position.

However, the threaded spindle 18 preferably can be motor driven, in this case by the motor drive 20, and in such case, the adjustment or setting rings or collars 21, on which the base elements or components 7 rest, can be locked or fixedly retained by friction or an external device and thus cannot turn or rotate together with the threaded spindle 18. Therefore, each of the locked or fixedly retained adjustment or setting rings or collars 21 are moved along the threaded spindle 18 either downwardly or upwardly depending upon the direction of rotation of the threaded spindle 18 as governed by the operation of the reversible motor drive 20.

When an adjustment or setting ring or collar 21 should not be positionally adjusted or no longer adjusted because it has reached the desired position, then with the calender closed the force exerting action of the related force-applying element 15 is reversed. In other words, the pressure medium (see, for instance, FIG. 3) is fed through the line or conduit 16 instead of through the line or conduit 17. In this manner, the related base element or component 7 is slightly raised from the associated adjustment or setting ring or collar 21. This adjustment or setting ring or collar 21 is thus relieved or not loaded, and hence now rotates in conjunction with the threaded spindle 18 and the aforedescribed axial movement of the adjustment ring or collar 21, does not take place.

It is to be understood that the illustrated embodiments are only exemplary and can be modified or altered in a number of different ways, some of which will now be briefly considered.

It is, for example, possible to replace the sliding or slide guide or guide structure 2 of the base elements or components 7 by substantially-parallel guides or elements or a similar lever arrangement, or any other equivalent guide structure.

The positional fixing or locking of each of the base elements or components 7 also can be effected by means of cable lines or chains, which can be adjusted via rollers or pinions. Furthermore, a gearing or gear unit movable along a vertical toothed rack or chain is also conceivable.

The adjustable stops or abutments 14 and 14' can be replaced by hydraulic stops and combined with the related force-applying element as described in the aforementioned German Published patent application No. 3,640,161 and the cognate U.S. Pat. No. 4,736,678. The speed or velocity of opening of the individual rolls or rollers thus can be controlled, with respect to magnitude and opening course or process, for example, by throttles, so that, for instance, hard impacts or blows can be avoided.

Furthermore, the force-applying elements 15 need not necessarily be constituted by a respective piston-and-cylinder unit or device. An alternative arrangement could be, for example, a pressure chamber formed of elastic material and similar to a bellows structure. Also it is conceivable to use magnetic or mechanical elements such as springs.

While there are shown and described present preferred embodiments of the invention, it is to be distinctly understood that the invention is not limited thereto, but may be otherwise variously embodied and practiced within the scope of the following claims.

Accordingly, what we claim is:

1. An apparatus for guiding superimposed rolls of an essentially vertical roll calender comprising a roll stand equipped with a plurality of the superimposed rolls, each of said superimposed rolls having opposite roll ends and a lengthwise axis, said guiding apparatus comprising:

a movable substantially lever-shaped element provided for the compensation of overhanging loads at each roll end of an associated one of said superimposed rolls;

each of said movable substantially lever-shaped elements being provided with a bearing for a related roll end of the associated roll;

means for pivotably mounting for substantially vertical pivotable movement each said movable substantially lever-shaped element;

said pivotably mounting means defining a pivot axis extending substantially parallel to the lengthwise axis of the associated roll;

a force-applying element provided for each said movable substantially lever-shaped element and acting upon said movable substantially lever-shaped element;

said force-applying element being capable of producing a force needed for compensation of overhanging loads and, when necessary, rendering such force ineffectual such that the associated roll can be lowered;

a base element provided for said each roll end;

means mounting each said base element at the roll stand of the roll calendar so as to be substantially vertically adjustable;

means for positionally fixing and supporting each base element in its substantially vertically adjusted position at least during a calendering operation;

said pivotably mounting means for the movable substantially lever-shaped element of the associated roll being arranged at said base element of the associated roll; and said force-applying element of the associated roll being arranged between said base element and said movable substantially lever-shaped element of the associated roll.

2. The apparatus as defined in claim 1, wherein:

said mounting means for each base element comprises guide means provided at the roll stand for guiding each said base element for movement in substantially vertical direction.

3. The apparatus as defined in claim 2, wherein:

said means for positionally fixing and supporting each base element in its substantially vertically adjusted position at least during a calendering operation comprises adjustable positioning means; and said adjustable positioning means substantially vertically adjusting said base element conjointly with said pivotably mounting means in order to compensate for changes in the diameter of the associated roll and to maintain said base element supported in a preselected vertical position.

4. The apparatus as defined in claim 3, wherein:

said adjustable positioning means comprises:

a substantially vertically extending threaded spindle;

a setting collar which is screwed onto said substantially vertically extending threaded spindle; and said base element resting upon and being supported by said setting collar in said preselected vertical position.

5. The apparatus as defined in claim 4, further including:

drive means for rotatably driving said substantially vertically extending threaded spindle; and means for actuating said force-applying element in a predeterminate direction for producing a relieving force at the setting collar supporting said base element in order to avoid an unintentional adjustment of said setting collar when said substantially vertically extending threaded spindle is rotatably driven.

6. The apparatus as defined in claim 5, wherein:

said means for actuating said force-applying element produces said overhanging load compensation force during said calendering operation and permits nip relieving the associated roll; and said means for actuating said force applying element produces said relieving force by operating the force-applying element in a reverse direction from that occurring during operation of the force-applying element when nip relieving the associated roll.

7. The apparatus as defined in claim 4, further including:

drive means for rotatably driving said substantially vertically extending threaded spindle.

8. The apparatus as defined in claim 4, wherein:

the force-applying element is structured such that a force produced by said force-applying element can at least take up a weight force acting upon the setting collar when the roll calender is closed, so that the base element can be raised in order to prevent an unintentional positional adjustment of the setting collar upon rotation of the threaded spindle.

9. The apparatus as defined in claim 8, wherein:

said force-applying element comprises a double-acting piston-and-cylinder unit whose direction of force application for taking up the weight force acting upon the setting collar when the roll calender is closed, is opposite to the direction of force application of the double-acting piston-and-cylinder unit when compensating the overhanging loads and that by transmitting the oppositely directed force produced by the force-applying element through the associated movable substantially lever-shaped element to the associated roll bearing, the associated roll can be raised relative to the roll situated therebelow and the base element can be raised from the setting collar.

10. The apparatus as defined in claim 1, further including:

means for limiting relative movement between the base element and the associated movable substantially lever-shaped element in order to limit downward movement of the associated roll in a nip relieved state of the essentially vertical roll calender.

11. The apparatus as defined in claim 10, further including:

means for limiting relative movement between the base element and the associated movable substantially lever-shaped element in order to limit upward movement of the associated roll and to enable such upward movement to entrainingly move the associated base element during a calendering operation.

12. The apparatus as defined in claim 11, wherein:

said relative movement limiting means comprise at least one adjustable stop means.

13. The apparatus as defined in claim 1, further including:

means for limiting relative movement between the base element and the associated movable substantially lever-shaped element in order to limit upward movement of the associated roll and to enable such upward movement to entrainingly move the associated base element during a calendering operation.

14. The apparatus as defined in claim 1, wherein:

said means for positionally fixing and supporting each base element in its substantially vertically adjusted position at least during a calendering operation comprises adjustable positioning means; and said adjustable positioning means substantially vertically adjusting said base element conjointly with said pivotably mounting means in order to compensate for changes in the diameter of the associated roll and to maintain said base element supported in a preselected vertical position.

15. The apparatus as defined in claim 14, wherein:

said movable substantially lever-shaped element arranged at said base element, extends in substantially horizontal direction in said preselected vertical position of said base element.

16. The apparatus as defined in claim 1, further including:

a first adjustable stop arranged between said base element and said movable substantially lever-shaped element; and said movable substantially lever-shaped element bearing against said first adjustable stop when the associated roll is lowered in order to produce a nip relieved state of the essentially vertical roll calender.

17. The apparatus as defined in claim 16, further including:

a second adjustable stop arranged between said base element and said movable substantially lever-shaped element;

said force-applying element being dimensioned to produce a force which exceeds the weight of the associated roll; and said movable substantially lever-shaped element bearing against said second adjustable stop when the associated roll is raised in order to produce a further nip relieved state of said essentially vertical roll calender.

18. The apparatus as defined in claim 1, wherein:

said movable substantially lever-shaped element arranged at said base element, comprises a single-armed lever; and said force-applying element acting upon said single-armed lever at a location between said pivot axis and said bearing of the associated roll.

19. The apparatus as defined in claim 1, wherein:

said movable substantially lever-shaped element comprises a two-armed lever;

one arm of said two-armed lever being directed away from said bearing of the associated movable substantially lever-shaped element; and said force-applying element acting upon said one arm of said movable substantially lever-shaped element.

20. The apparatus as defined in claim 1, further including:

a hydraulic pressure source; and each said force-applying element arranged between said base element and said movable substantially lever-shaped element, comprises a piston-and-cylinder unit connected to said hydraulic pressure source to be acted upon by a pressurized hydraulic medium supplied by said hydraulic pressure source.

21. The apparatus as defined in claim 1, further including:

a source for a predetermined gaseous medium; and each said force-applying element arranged between said base element and said movable substantially lever-shaped element, comprises a piston-and-cylinder unit connected to said source of pressurized gaseous medium to be acted upon by a pressurized gaseous medium supplied by said source.

22. In an apparatus for guiding superimposed rolls of an essentially vertical roll calender comprising a roll stand equipped with a plurality of the superimposed rolls, each of said rolls having opposite roll ends and a lengthwise axis, said guiding apparatus comprising:

a movable element provided for the compensation of overhanging loads at a roll end of an associated one of said superimposed rolls;

said movable element being provided with a bearing for the roll end of the associated one roll;

means for pivotably mounting said movable element for substantially vertical pivotable movement;

said pivotably mounting means defining a pivot axis extending substantially parallel to the lengthwise axis of the associated roll;

a force-applying element provided for said movable element and acting upon said movable element;

said force-applying element being capable of producing a force needed for compensation of the overhanging loads at the roll end of the associated roll;

a base element provided for said roll end;

means mounting said base element at the roll stand of the roll calender so as to be substantially vertically adjustable;

means for positionally fixing and supporting said base element in its substantially vertically adjusted position at least during a calendering operation;

said pivotably mounting means for the movable element of the associated roll being arranged at said base element of the associated roll; and said force-applying element of the associated roll being arranged between said base element and said movable element of the associated roll.

23. The apparatus as defined in claim 22, wherein:

said means for positionally fixing and supporting said base element in its substantially vertically adjusted position at least during the calendering operation, comprising a selectively movable element engaging with the base element; and said force-applying element cooperating with said base element such that said base element can be positionally adjusted to render said selectively movable element ineffective for altering the position of said base element.

24. The apparatus as defined in claim 22, wherein:

said means for positionally fixing and supporting said base element substantially vertically adjust said base element conjointly with said movable element in order to compensate for changes in the diameter of the associated roll and maintain said base element supported in a preselected vertical position.

25. The apparatus as defined in claim 24, wherein: said movable substantially lever-shaped element arranged at said base element, extends in substantially horizontal direction in said preselected vertical position of said base element.

* * * * *